US006164257A

United States Patent [19]

Kobayashi

[11] Patent Number: 6,164,257

[45] Date of Patent: Dec. 26, 2000

[54] OIL PASSAGE CONSTRUCTION FOR AN ENGINE WITH AN OIL PRESSURE CONTROL DEVICE

[75] Inventor: Tsutomu Kobayashi, Shizuoka-ken, Japan

[73] Assignee: Suzuki Motor Corporation, Shizuoka-ken, Japan

[21] Appl. No.: 09/401,902

[22] Filed: Sep. 23, 1999

[30] Foreign Application Priority Data

Sep. 30, 1998 [JP] Japan ..... 10-292904

[51] Int. Cl.[7] ..... F01M 1/06

[52] U.S. Cl. ..... 123/90.33; 123/196 M; 123/193.3; 184/6.5

[58] Field of Search ..... 123/90.17, 90.33, 123/90.34, 90.38, 196 R, 196 M, 193.5, 193.3; 184/6.5, 6.6

[56] References Cited

U.S. PATENT DOCUMENTS

| | | | |
|---|---|---|---|
| 4,729,349 | 3/1988 | Sonoda et al. | 123/90.34 |
| 4,800,850 | 1/1989 | Yoshida et al. | 123/90.16 |
| 4,942,855 | 7/1990 | Muto | 123/90.33 |
| 5,052,351 | 10/1991 | Nishimura et al. | 123/90.27 |
| 5,143,034 | 9/1992 | Hirose | 123/196 R |
| 5,144,921 | 9/1992 | Clos et al. | 123/90.17 |
| 5,813,376 | 9/1998 | Sakaguchi et al. | 123/90.16 |
| 5,904,226 | 5/1999 | Sakaguchi et al. | 184/67 |

FOREIGN PATENT DOCUMENTS

| | | |
|---|---|---|
| 61-179312 | 11/1986 | Japan . |
| 05171904 | 7/1993 | Japan . |
| 05288022 | 11/1993 | Japan . |
| 09079019 | 3/1997 | Japan . |
| 09170415 | 6/1997 | Japan . |
| 09170416 | 6/1997 | Japan . |
| 10030418 | 2/1998 | Japan . |

*Primary Examiner*—Weilun Lo
*Attorney, Agent, or Firm*—Flynn, Thiel, Boutell & Tanis, P.C.

[57] ABSTRACT

An engine has an oil passage for supplying oil discharged by an oil pump. An oil passage for a driving valve system, an oil passage for auxiliary machines, and a controlling oil passage all branch from the pump oil passage. A throttle portion for controlling the amount of oil supplied to a driving valve system is provided in the valve system passage, and a throttle portion for controlling the amount of oil supplied to auxiliary machines is provided in the auxiliary passage.

7 Claims, 5 Drawing Sheets

OIL PASSAGE CONSTRUCTION FOR AN ENGINE WITH AN OIL PRESSURE CONTROL DEVICE

FIELD OF THE INVENTION

This invention relates to an oil passage construction for an engine with an oil pressure control device, and particularly to an oil passage construction capable of preventing reduction in the amount of controlling oil supplied to the oil pressure control device, of ensuring responsiveness of the oil pressure control device, and of reducing waste oil while ensuring that an adequate amount of oil is supplied to a driving valve system, auxiliary machines and the oil pressure control device.

BACKGROUND OF THE INVENTION

The engine mounted on vehicles or the like is provided with a driving valve system, auxiliary machines, an oil pressure control device and other similar devices. Oil discharged from an oil pump is supplied through respective oil passages to these devices or systems for lubrication, operation and control thereof.

Such an oil passage construction for an engine with an oil pressure control device as described above is shown in FIGS. 7 and 8. In FIG. 7, reference numeral 102 designates an engine with an oil pressure control device (hereinafter referred to as "an engine"), 104 a cylinder block, 106 a lower case, 108 an oil pan, 110 a cylinder head, 112 a head cover, and 114 a chain case. In the engine 102, a crank shaft 116 is provided on the cylinder block 104, and intake and exhaust cam shafts 118, 120 for driving intake and exhaust valves (not shown) in the driving valve system are supported on the cylinder head 110.

In the intake and exhaust cam shafts 118, 120, intake and exhaust journal portions 122, 124 are supported on cam shaft bearings 126, 128 of the cylinder head 110 by intake and exhaust cam shaft caps 130, 132.

The engine 102 is provided with an oil pump 134 driven by the crank shaft 116, a chain tensioner 136 as an auxiliary machine for imparting tension to a timing chain (not shown) which acts as a driving force transmitting unit for a driving valve for transmitting rotation of the crank shaft 116 to the intake and exhaust cam shafts 118, 120, and an oil control valve 140 of a variable valve timing device 138 as an oil pressure control device.

In the oil passage construction for the engine 102, an oil passage 142 is provided on the block side to which oil discharged by the oil pump 134 is supplied, and a throttle portion 144 is provided on the oil passage 142 on the block side. Oil controlled in amount by the throttle portion 144 on the block side is supplied to an oil passage 146 provided in the cylinder head 106.

FIG. 8 illustrates an oil passage 148 for supplying oil for a driving valve system to the intake and exhaust journal portions 122, 124 of the respective intake and exhaust cam shafts 118, 120, an oil passage 150 for supplying oil to auxiliary machines such as the chain tensioner 136, and a controlling oil passage 152 for supplying controlling oil to the oil control valve 140 of the variable valve timing device 138. The aforementioned passages branch from or communicate with the head-side oil passage 146.

The oil passage 148 for the driving valve system branches into oil passages 154, 156 for the respective intake and exhaust cam shafts to supply oil to the intake and exhaust cam shaft caps 130, 132 to lubricate the intake and exhaust journal portions 122, 124. The oil passage 150 supplies oil to the chain tensioner 136 to actuate a plunger (not shown) to apply tension to the timing chain.

The controlling oil passage 152 supplies controlling oil to the oil control valve 140. The operation of the oil control valve 140 is controlled by control means (not shown) so as to supply controlling oil to a hydraulic actuator 162 provided on one end of the intake cam shaft 118 via an advance angle oil passage 158 and a delay angle oil passage 160, so that the phase of the intake cam shaft 118 relative to the crank shaft 116 can be changed to vary valve timing of the intake and exhaust valve.

The oil passage construction for an engine with an oil pressure control device as described above is disclosed in Japanese Utility Model Application Laid-Open No. 61-179312, Japanese Patent Application Laid-Open No. 5-171904, Japanese Patent Application Laid-Open No. 5-288022, Japanese Patent Application Laid-Open No. 9-79019, Japanese Patent Application Laid-Open No. 9-170415, Japanese Patent Application Laid-Open No. 9-170416, and Japanese Patent Application Laid-Open No. 10-30418.

Japanese Utility Model Application Laid-Open 61-179312 discloses-an orifice for controlling the oil amount which is provided in an oil supply passage for supplying oil to a driving valve mechanism. Japanese Patent Application Laid-Open No. 5-171904, Japanese Patent Application Laid-Open No. 5-288022, Japanese Patent Application Laid-Open No. 9-79019, Japanese Patent Application Laid-Open No. 9-170415, Japanese Patent Application Laid-Open No. 9-170416, and Japanese Patent Application Laid-Open No. 10-30418 are all concerned with the passage construction in which an oil control valve for supplying advance angle oil and delay angle oil to a hydraulic actuator of a variable valve timing device is provided on one end of a cam shaft to provide an advance angle oil passage and a delay angle oil passage for advance angle oil and delay angle oil, respectively.

In the oil passage construction shown in FIGS. 7 and 8, the throttle portion 144 is provided in the oil passage 142 on the block side, and the quantity of oil supplied to the oil passage 146 on the head side is controlled by the throttle portion 144 to thereby ensure that an adequate amount of oil is supplied for lubrication of the crank shaft 116. However, in the oil passage construction shown in FIGS. 7 and 8, since the amount of oil supplied to the oil passage 146 on the head side is controlled, the controlling oil amount supplied to the oil control valve 140 is also limited and reduced. This poses an inconvenience in that the responsiveness of the hydraulic actuator 162 controlled by the oil control valve 140 decreases.

Such an inconvenience as described above can be overcome by removing the throttle portion 144 on the block side. However, the removal of the throttle portion 144 on the block side not only results in an inconvenience as to the quantity of oil supplied for lubrication of the crank shaft 116, but also results in the inconvenience in that oil supplied to the oil passage 146 on the head side is supplied to the intake and exhaust cam shaft caps 130, 132 and the chain tensioner 134 in a greater amount than is necessary and as a result, the controlling oil amount supplied to the oil control valve 140 fails to fulfill the necessary amount.

It is necessary for overcoming the inconveniences as described above to increase the discharge amount of the oil pump 134. However, this poses an inconvenience in that the oil pump 134 becomes large in size, and an inconvenience in that the mechanical loss of the engine 102 is increased due to the larger-size of the oil pump 134.

SUMMARY OF THE INVENTION

In order to obviate or minimize the above inconveniences of known oil passage constructions, an oil pump driven by a crank shaft of the engine is provided, an oil passage for supplying oil discharged by the oil pump is provided, which oil passage branches into a valve system oil passage for supplying oil to a driving valve system of the engine, an auxiliary oil passage for supplying oil to auxiliary machines of the engine, and a controlling oil passage for supplying oil to the oil pressure control device of the engine. Further, a throttle portion is provided in the valve system oil passage for controlling the oil amount to the driving valve system, and a throttle portion is provided in the auxiliary oil passage for controlling the oil amount to the auxiliary machines.

Further, a throttle diameter of the throttle portion for the valve system is set to be larger than a throttle diameter of the throttle portion for the auxiliary machines, and a diameter of the controlling oil passage is set to be larger than the throttle diameters for the valve system and auxiliary machines.

In addition, an oil control valve of the oil pressure control device is provided on a receiving unit case which is mounted on a head end wall in the axial direction of a crank of the cylinder head to form a receiving chamber for a unit for transmitting a driving force for a driving valve, and the controlling oil passage for supplying controlling oil to the oil control valve is provided on the head end wall.

Another aspect of the invention relates to a sole throttle portion which is provided in the oil passage, the controlling oil passage branches from the oil passage upstream of the throttle portion, and the valve system oil passage and the auxiliary oil passage branch from the oil passage downstream of the throttle portion.

In an oil passage construction for an engine with an oil pressure control device according to this invention, an oil passage for a driving valve system, an oil passage for auxiliary machines, and a controlling oil passage branch from an oil passage supplied with oil discharged by an oil pump, a throttle portion is provided in the oil passage for the driving valve system, and a throttle portion is provided in the oil passage for the auxiliary machines, whereby the quantity of oil for the driving valve system and the quantity of oil for the auxiliary machines are respectively controlled, whereas the quantity of controlling oil supplied to the oil pressure control device is not controlled, thus ensuring an adequate quantity of controlling oil.

Further, a throttle diameter of the throttle portion for the driving valve system is set to be larger than a throttle diameter of the throttle portion for the auxiliary machines, whereby the oil amount for the driving valve system necessary and sufficient for operation of the driving valve system can be ensured without impairing the oil amount necessary for the operation of auxiliary machines; and a diameter of the controlling oil passage is set to be larger than the throttle diameter for the driving valve system and the throttle diameter for the auxiliary machines so that a sufficient amount of controlling oil can be ensured.

Further, an oil control valve of an oil pressure control device is provided on a receiving unit case mounted on a head end wall on one end side in the axial direction of a crank of a cylinder head to form a receiving chamber for a unit for transmitting a driving force for a driving valve, and a controlling oil passage for supplying controlling oil to the oil control valve is provided on a head end wall, whereby the controlling oil passage can be formed making use of constituent members of the engine, and processing of the controlling oil passage and piping can be reduced.

Moreover, a sole throttle portion is provided in an oil passage, a controlling oil passage branchs from the oil passage upstream of the throttle portion, and an oil passage for a driving valve system and an oil passage for auxiliary machines branch from the oil passage downstream of the throttle portion, whereby a necessary amount of the controlling oil can be ensured while controlling the oil amount for a driving valve system and the oil amount for auxiliary machines via the sole throttle portion.

DETAILED DESCRIPTION

Figure 1:
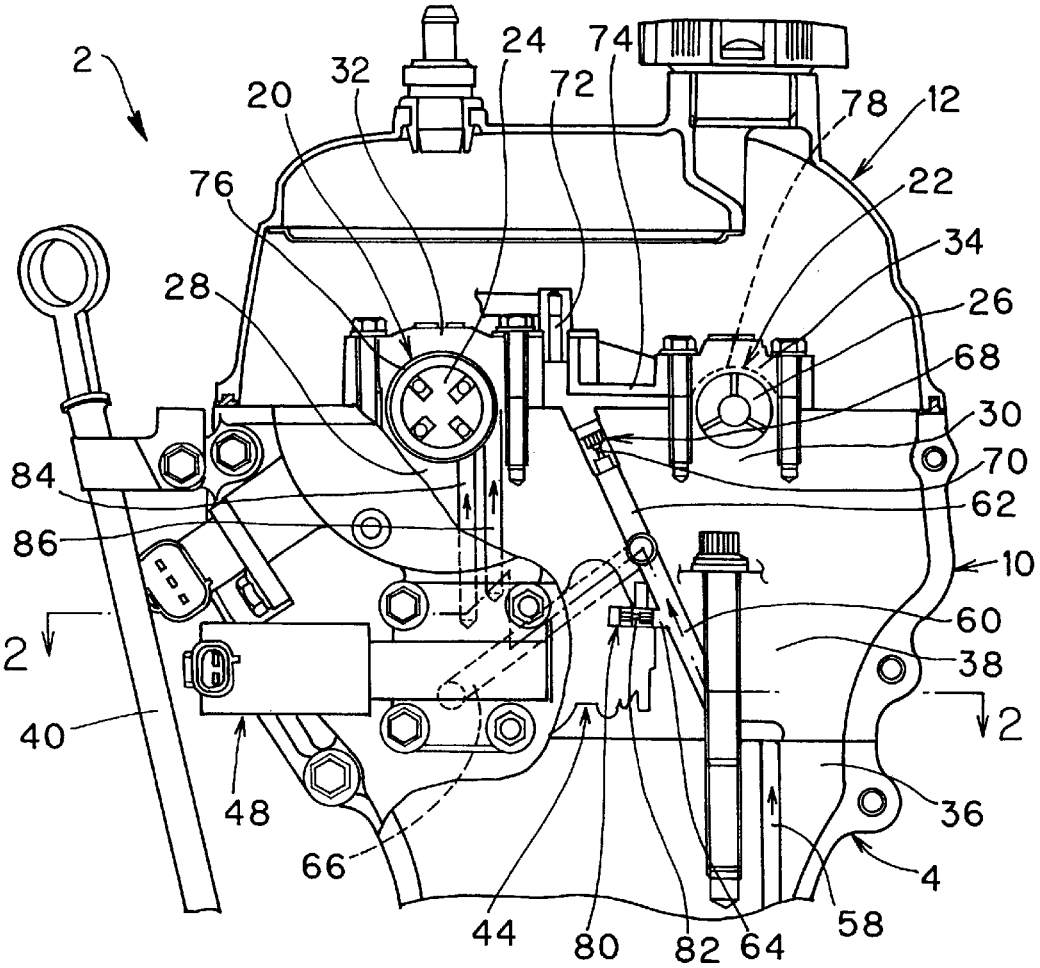
FIG. 1 is a diagrammatical, fragmentary view of a cylinder head in an enlarged fragmentary section showing an embodiment of an oil passage construction for an engine with an oil pressure control device according to this invention.
Figure 2:
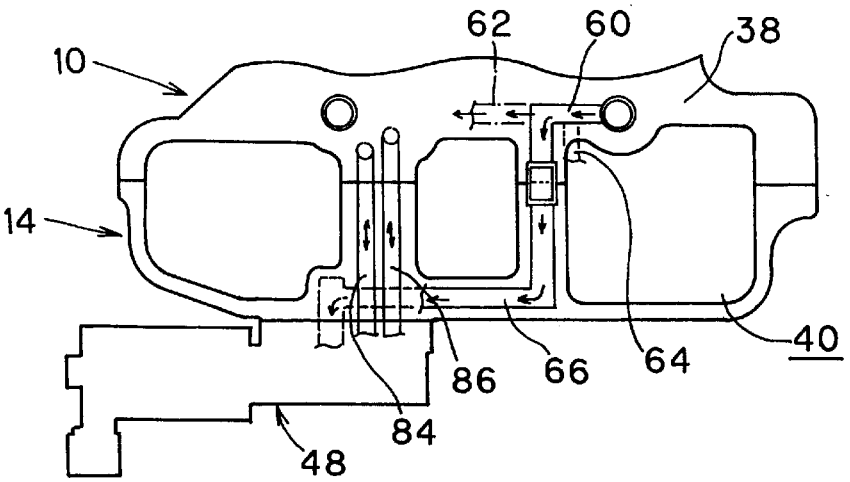
FIG. 2 is a sectional view taken on line 2—2 of FIG. 1.
Figure 3:
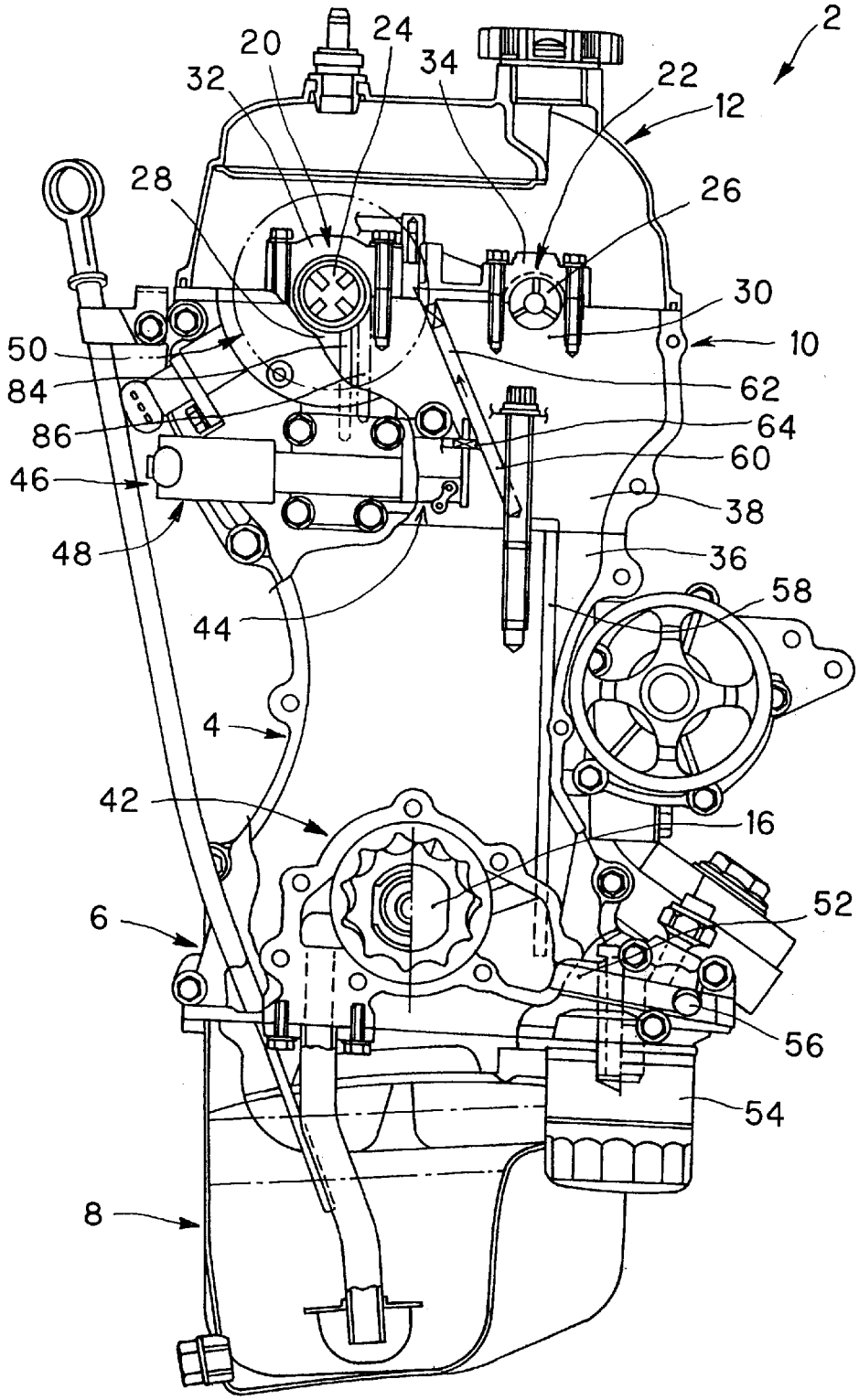
FIG. 3 is a diagrammatic view of an engine with an oil pressure control device in fragmentary section.

The embodiments of this invention will be described hereinafter with reference to the drawings. FIGS. 1 to 4 show a first embodiment of this invention. Referring to FIGS. 1 to 3, reference numeral 2 designates an engine with an oil pressure control device (hereinafter referred to as "an engine"), 4 a cylinder block, 6 a lower case, 8 an oil pan, 10 a cylinder head, 12 a head cover, and 14 a chain case. In this engine 2, a crank shaft 16 is supported on the cylinder block 4 by the lower case 6, and intake and exhaust cam shafts 20, 22 for driving intake and exhaust valves (not shown) of a driving valve system are supported on the cylinder head 10.

Intake and exhaust journal portions 24, 26 are supported in the intake and exhaust cam shafts 20, 22 on intake and exhaust cam shaft bearings 28, 30 of the cylinder head 10 by intake and exhaust cam shaft caps 32, 34. The engine 2 is provided with a timing chain (not shown) as a driving force transmission unit for a driving valve for transmitting rotation of the crank shaft 16 to the intake and exhaust cam shafts 20, 22. The timing chain is extended over a crank sprocket (not shown) provided on the crank shaft 16 and intake and exhaust cam shaft sprockets (not shown) provided on the intake and exhaust cam shafts 20, 22.

In the engine 2, as shown in FIG. 2, the chain case 14 for covering or receiving the timing chain is mounted on an end wall 36 of the block and an end wall 38 of the head in an axial direction of the crank of the cylinder block 4 and the cylinder head 10 to form a chain chamber 40.

In the engine 2, an oil pump 42 driven by the crank shaft 16 is provided on the chain cover 14, a chain tensioner 44 for applying tension to the timing chain is mounted on the head end wall 38 of the cylinder head 10, and an oil control valve 48 of a variable valve timing device 46 which serves as an oil pressure control device is mounted on the chain cover 14 mounted on the head end wall 38 of the cylinder head 10.

In the variable valve timing device 46, a hydraulic actuator 50 is provided on one end side of the intake cam shaft 20. The operation of oil control valve 48 is controlled by control means (not shown) to supply advance angle oil and delay angle oil to the hydraulic actuator 50 to thereby change the phase (i.e. angle) of the intake cam shaft 20 with respect to the crank shaft 16 to render variable the valve timing of the intake and exhaust valves.

In the oil passage construction of the engine 2, an exhaust-side passage 52 of the oil pump 42 communicates with an oil filter 54, and a main oil passage 56 to which oil filtered by the oil filter 54 is supplied is provided in the axial direction of the crank of the cylinder block 4. The cylinder block 4 is provided with an oil passage for a crank shaft (not shown) for supplying oil from the main oil passage 56 to a crank journal portion (not shown) of the crank shaft 16.

The block end wall 36 of the cylinder block 4 is provided with an oil passage 58 on the block side for directing oil from the main oil passage 56 toward the cylinder head 10. The head end wall 38 of the cylinder head 10 is provided with an oil passage 60 on the head side to which oil from the oil passage 58 on the block side is supplied.

As shown in FIGS. 1 and 2, the oil passage 60 on the head side branches into an oil passage 62 for supplying oil for a driving valve system to the intake and exhaust journal portions 24, 26 of the intake and exhaust cam shafts 20, 22, an oil passage 64 for supplying oil for auxiliary machines to the chain tensioner 42, and a controlling oil passage 66 for supplying controlling oil to the oil control valve 48 of the variable valve timing device 46.

The oil passage 62 for a driving valve system is provided with a throttle member 68 for a driving valve system, the throttle member 68 being provided with a throttle portion 70 for controlling the oil amount supplied to a driving valve system, and the downstream side of the throttle portion 70 branches into oil passages 72, 74 for intake and exhaust cam shafts. The oil passages 72, 74 for intake and exhaust cam shafts respectively communicate with intake and exhaust cam shaft cap oil passages 76, 78 of the intake and exhaust cam shaft caps 32, 34. The oil passage 62 for a driving valve system supplies oil to the intake and exhaust cam shaft cap oil passages 76, 78.

The oil passage 64 for auxiliary machines is provided with a throttle member 80. The throttle member 80 is provided with a throttle portion 82 for controlling the amount of oil supplied to auxiliary machines, and the downstream side of the throttle portion 82 communicates with the chain tentioner 44. The oil passage 64 for auxiliary machines supplies oil to the chain tensioner 44.

A throttle diameter d1 of the throttle portion 70 for a driving valve system is set to be larger than a throttle diameter d2 of the throttle portion 82 for auxiliary machines 82 d1>d2.

The controlling oil passage 66 communicates with the oil control valve 48. A diameter d3 of the controlling oil passage 66 is set to be larger than the throttle diameter d1 of the throttle portion 70 and the throttle diameter d2 of the throttle portion 82 (d1<d3 and d2<d3). The controlling oil passage 66 communicates with the head end wall 38 of the cylinder head 10 and the chain case 14 provided on the head end wall 38 to supply controlling oil to the oil control valve 48.

The operation of the oil control valve 48 is controlled by control means (not shown) and control valve 48 supplies advance angle oil and delay angle oil to an advance angle oil passage 84 and a delay angle oil passage 86, respectively. The advance angle oil passage 84 and the delay angle oil passage 86 communicate with the chain case 14 on which the oil control valve 48 is provided, the head end wall 38, the intake cam shaft bearing 28 and the intake journal portion 24 of the intake cam shaft 20, and the advance angle oil and the delay angle oil are supplied to the hydraulic actuator 50 provided on one end of the intake cam shaft 20.

The operation of the invention will now be described.

Oil discharged by the oil pump 42 is filtered by the oil filter 54, supplied to the main oil passage 56, and supplied to the oil passage 58 on the block side. Oil from the oil passage 58 on the block side is supplied to the oil passage 60 on the head side of the cylinder head 10, and branched into and supplied to the oil passage 62 for a driving valve system, the oil passage 64 for auxiliary machines and the controlling oil passage 66.

The amount of oil supplied to the valve system oil passage 62 is controlled by the throttle portion 70 which supplies oil to the intake and exhaust cam shaft cap oil passages 76, 78 of the intake and exhaust cam shaft caps 32, 34 by the oil passages 72, 74 to lubricate the intake and exhaust journal portions 24, 26.

The amount of oil supplied to the auxiliary oil passage 64 is controlled by the throttle portion 82 which supplies oil to the chain tensioner 44 to actuate a plunger (not shown) to apply tension to the timing chain.

Oil supplied to the controlling oil passage 66 is supplied to the oil control valve 48. The operation of the oil control valve 48 is controlled by control means (not shown) and the controlling oil supplied is put in advance angle oil and delay angle oil. The advance angle oil and delay angle oil are supplied to the hydraulic actuator 50 by the advance angle oil passage 84 and the delay angle oil passage 86, respectively, to change the phase of the intake cam shaft 20 relative to the crank shaft 16 to vary the valve timing of the intake and exhaust valves.

As described above, in the oil passage construction of the engine 2, the oil passage 62 for a driving valve system, the oil passage 64 for auxiliary machines and the controlling oil passage 66 branch from the main oil passage 60 on the head side; the throttle portion 70 for controlling the amount of oil supplied to the driving valve system is provided in the oil passage 62; and the throttle portion 82 for controlling the amount of oil supplied to auxiliary machines is provided in the oil passage 64. Thus, the amount of oil supplied to the driving valve system and the amount of oil supplied to the auxiliary machines are controlled, whereas the amount of controlling oil supplied to the oil control valve 48 of the variable valve timing device 46 is not controlled to ensure the necessary amount of controlling oil.

Therefore, there is provided an oil passage construction for the engine 2 which is capable of preventing a reduction in the amount of controlling oil supplied to the oil control valve 48, capable of ensuring responsiveness of the hydraulic actuator 50 supplied with advance angle oil and delay angle oil by the oil control valve 48, and capable of reducing waste oil while ensuring amounts of oil supplied to the intake and exhaust cam shaft caps 32, 34 of the driving valve system, the chain tensioner 44 as the auxiliary machines and the oil control valve 48 of the variable valve timing device 46.

Further, in the oil passage construction for the engine 2, the throttle diameter d1 of the throttle portion 70 for the driving valve system is set to be larger than the throttle diameter d2 of the throttle portion 82 for auxiliary machines whereby it is possible to ensure that an adequate amount of oil is supplied to a driving valve system necessary for lubrication of the intake and exhaust cam shaft caps 32, 34 without impairing the supply of oil necessary for operation of the chain tensioner 44. The diameter d3 of the controlling oil passage 66 is set to be larger than the throttle diameter d1 for a driving valve system and the throttle diameter d2 for auxiliary machines (d1<d3 and d2<d3) whereby it is possible to secure the necessary amount of controlling oil.

Further, in the oil passage construction of the engine 2, the oil control valve 48 is provided on the chain case 14 which is mounted on the head end wall 38 in the axial direction of the crank of the cylinder head 10, and the controlling oil passage 66 for supplying controlling oil to the oil control valve 48 is provided on the head end wall 38, whereby it is possible to form the controlling oil passage 66 making use of the cylinder head 10 and the chain case 14 which are constituent members of the engine 2, and to reduce processing of the controlling oil passage 66 and piping.

Figure 4:
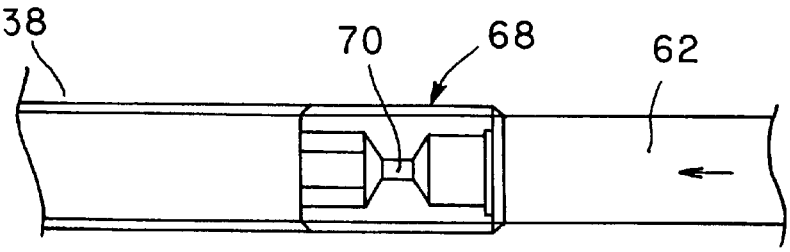
FIG. 4 is an enlarged sectional view of a throttle portion for a driving valve system.
Figure 5:
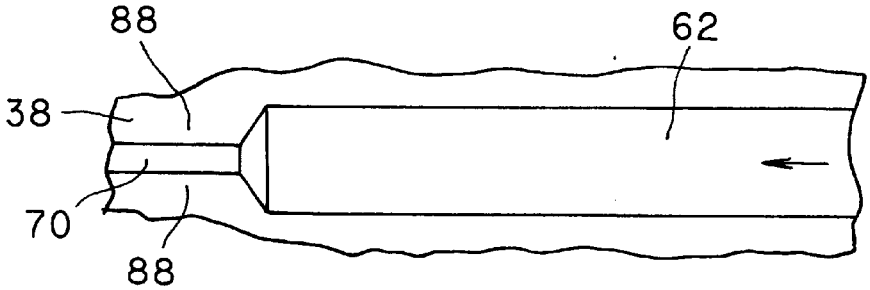
FIG. 5 is an enlarged sectional view showing a separate embodiment of the throttle portion for a driving valve system.

In the embodiment of FIG. 4, the throttle member 68 for a driving valve system is provided in the oil passage 62 for a driving valve system, and the throttle portion 70 is provided on the throttle member 68 for a driving valve system. However, as shown in FIG. 5, a projection portion 88 can be provided which projects into the oil passage 62 to thereby reduce the diameter thereof to provide the throttle portion 70 for a driving valve system. In other words, the passage 62 can be restricted by a projecting portion 88 which serves as a throttle.

Although not shown, the same is true for the throttle portion 82 for controlling the amount of oil supplied to auxiliary machines. That is, a projecting portion (not shown) can be provided which projects into the oil passage 64 for a chain tensioner to thereby reducing the diameter of oil passage 64.

Figure 6:
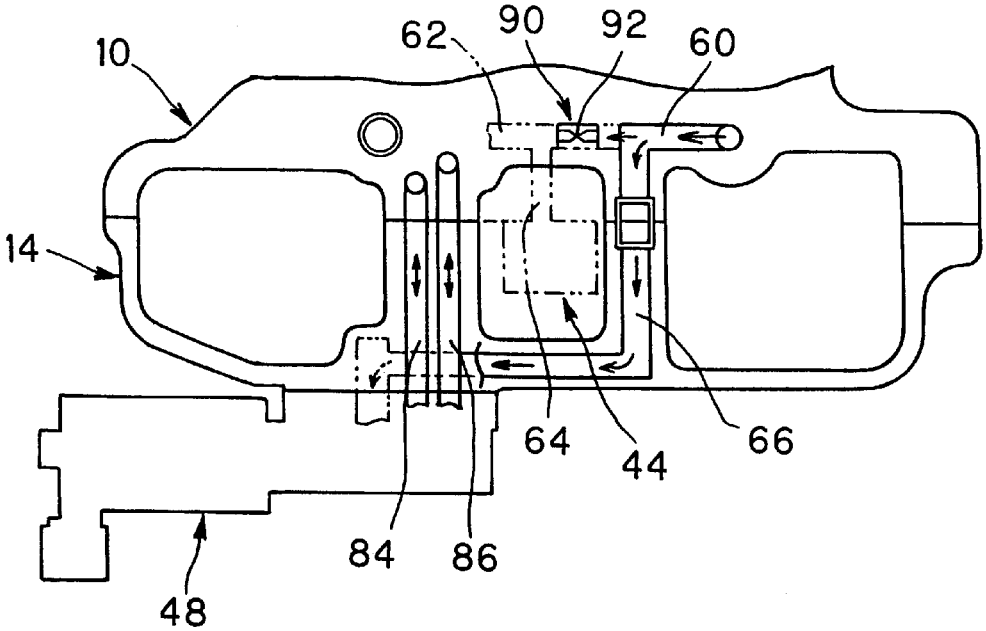
FIG. 6 is a sectional view of a cylinder head and a head cover showing another embodiment.
Figure 7:
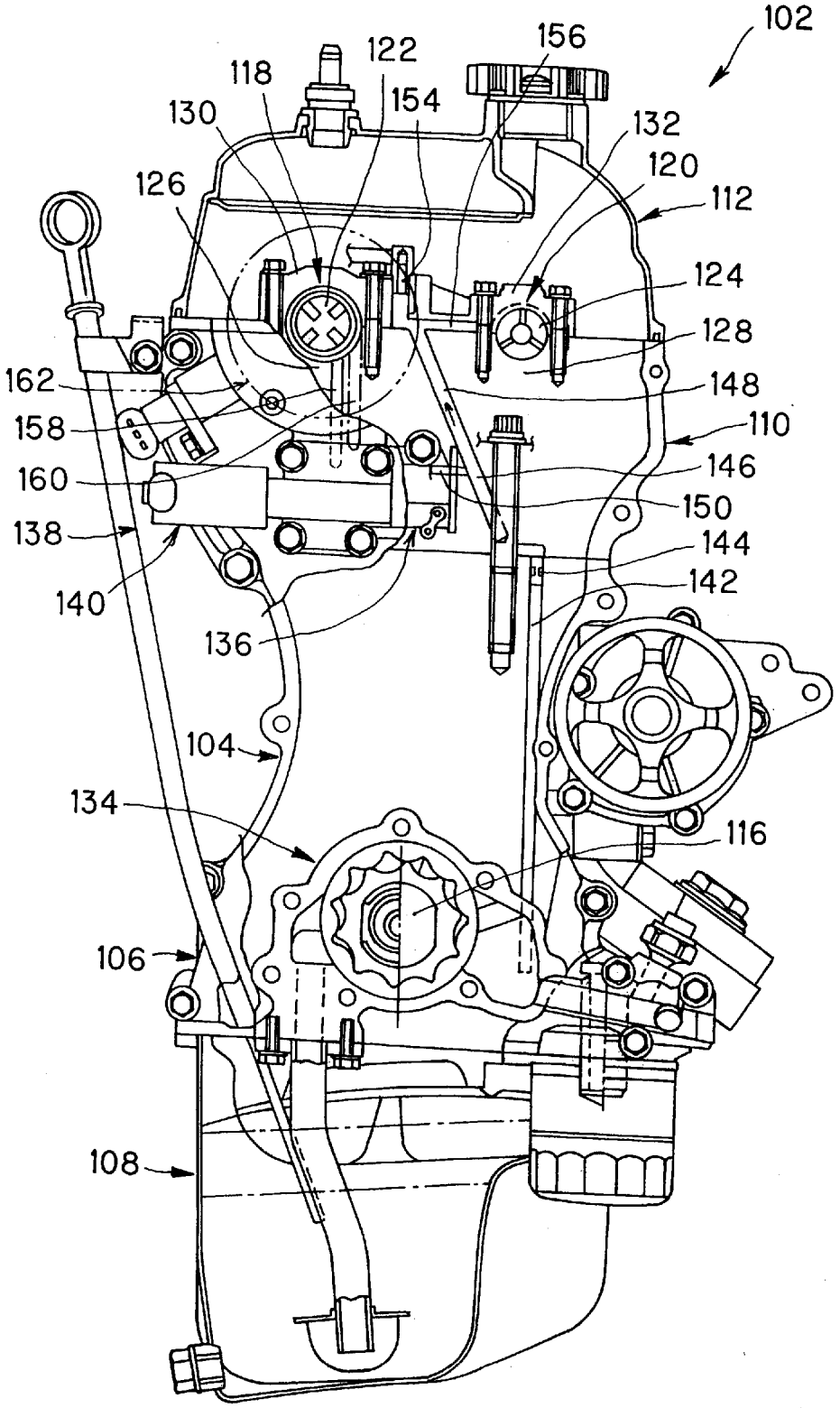
FIG. 7 PRIOR ART
FIG. 7 is a diagrammatic view of a engine with an oil pressure control device in fragmentary section showing a conventional construction.
Figure 8:
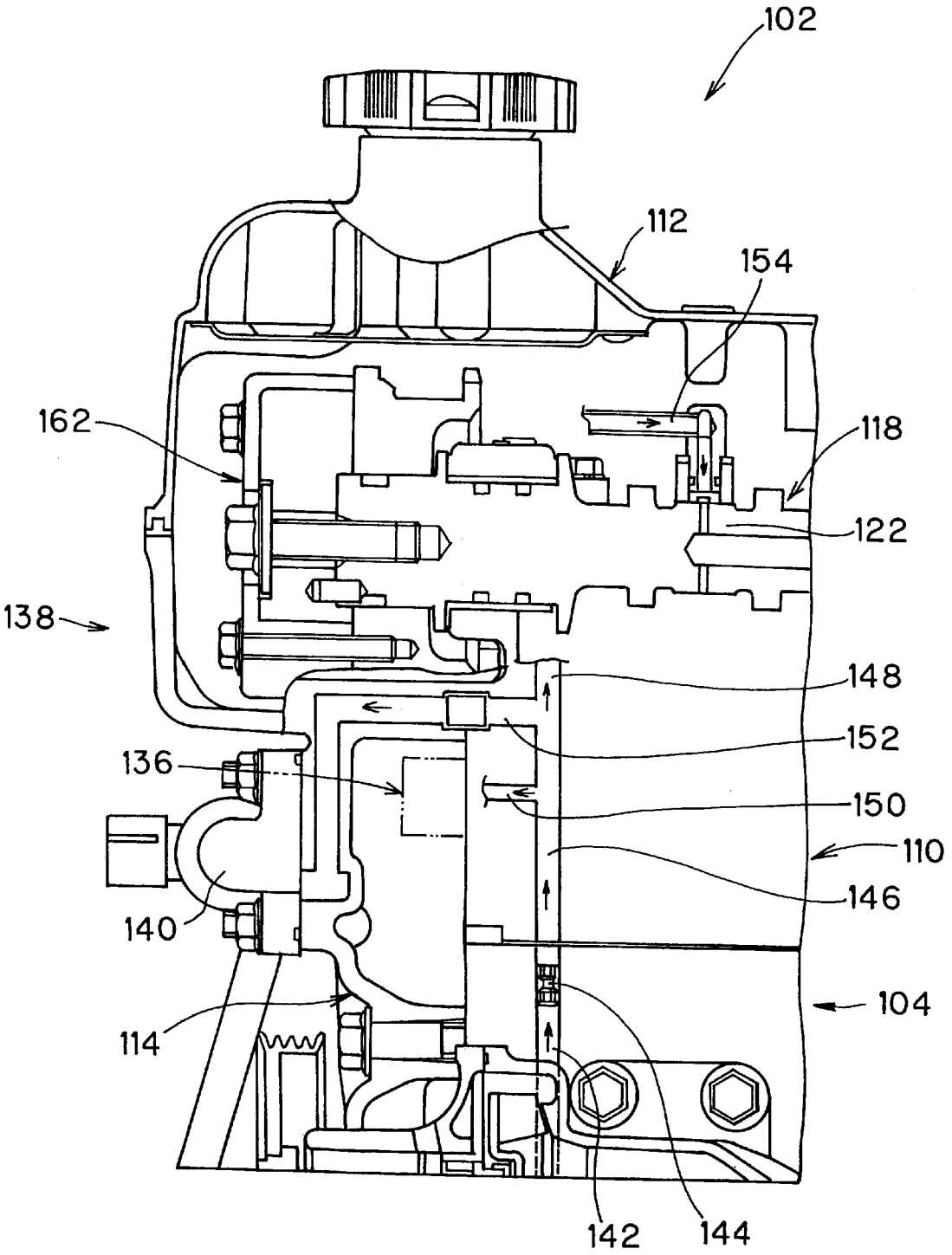
FIG. 8 PRIOR ART
FIG. 8 is an enlarged sectional view of the cylinder head of FIG. 7.

FIG. 6 shows a separate embodiment of this invention. In this embodiment, a sole throttle member 90 is mounted on the oil passage 60 on the head side, and a throttle portion 92 is provided on the throttle member 90. Further, a controlling oil passage 66 branches from the oil passage 60 on the head side upstream of the throttle portion 92, and an oil passage 62 for a driving valve system and an oil passage 64 for auxiliary machines branch from the oil passage 60 on the head side downstream of the throttle portion 92.

In the oil passage construction according to this embodiment, oil from the oil passage 60 downstream of the sole throttle portion 90 is supplied to the oil passage 62 for a driving valve system and to the oil passage 64 for auxiliary machines, whereas oil not supplied from the oil passage 60 upstream of the sole throttle portion 92 is supplied to the controlling oil passage 66 as the controlling oil amount. With this construction, it is possible to control the amount of oil supplied to a driving valve system and to auxiliary machines with the sole throttle portion 92, without restricting the amount of oil supplied to the controlling oil passage 60.

Therefore, the oil passage construction according to this separate embodiment is capable of preventing reduction of an amount of controlling oil supplied to the oil control valve 48, capable of securing responsiveness of the hydraulic actuator 50 operated while being supplied with advance angle oil and delay angle oil by the oil control valve 48, and capable of reducing waste oil while ensuring that an adequate amount of oil is respectively supplied to the intake and exhaust cam shaft caps 32, 34 of a driving valve system, the chain tensioner 44 as the auxiliary machine and the oil control valve 48 of the variable valve timing device 46.

As described above, in the oil passage construction for the engine with an oil pressure control device according to this invention, the oil amount for a driving valve system and the oil amount for auxiliary machines are respectively controlled, while the oil amount supplied to the oil pressure control device is not controlled in order to ensure that a sufficient amount of oil is supplied to the oil pressure control device.

Therefore, the oil passage construction with an oil pressure control device according to this invention is capable of preventing reduction of an amount of controlling oil supplied to the oil pressure control device, capable of securing responsiveness of the oil pressure control device, and capable of reducing oil not to be used while securing proper oil amounts respectively supplied to the driving valve system, the auxiliary machines and the oil pressure control device.

Although a particular preferred embodiment of the invention has been disclosed in detail for illustrative purposes, it will be recognized that variations or modifications of the disclosed apparatus, including the rearrangement of parts, lie within the scope of the present invention.

What is claimed is:

1. An oil passage construction for an engine with an oil pressure control device and an oil pump driven by a crank shaft of the engine, said oil passage construction comprising an oil passage for transporting oil discharged by said oil pump; said oil passage being branched into a valve system oil passage for supplying oil to the driving valve system of said engine, an auxiliary oil passage for supplying oil to auxiliary machines of said engine, and a controlling oil passage for supplying oil to the oil pressure control device of said engine; a throttle portion provided in said valve system oil passage for controlling the amount of oil supplied to the driving valve system; and a throttle portion provided in said auxiliary oil passage for controlling the amount of oil supplied to said auxiliary machines.

2. The oil passage construction according to claim 1, wherein a throttle diameter of said throttle portion for said driving valve system oil passage is larger than a throttle diameter of said throttle portion for said auxiliary oil passage, and a diameter of the controlling oil passage is larger than said throttle diameters for said valve system and auxiliary oil passages.

3. The oil passage construction according to claim 1, wherein an oil control valve of said oil pressure control device is provided on a receiving unit case mounted on a head end wall on one end side in the axial direction of a crank of said cylinder head to form a receiving chamber for a unit for transmitting a driving force for a driving valve, and said controlling oil passage for supplying controlling oil to said oil control valve is provided on said head end wall and said receiving unit case.

4. An oil passage construction for an engine having an oil pump, an oil pressure control device, a driving valve system, and at least one auxiliary machine, said construction comprising;

a first oil passage for transporting oil discharged from the oil pump;

a second oil passage for supplying oil to the driving valve system;

a third oil passage for supplying oil to the auxiliary machine;

a fourth oil passage for supplying oil to the oil pressure control device, said second, third and fourth passages all communicating with, and branching from said first oil passage; and a throttle associated with said second and third oil passages for restricting the quantity of oil supplied to the driving valve system and the auxiliary machine as compared to the quantity of oil supplied to the oil pressure control device via said fourth oil passage.

5. The oil passage construction of claim 4 wherein a separate said throttle is provided in each of said second and third passages.

6. The oil passage construction of claim 5, wherein a cross-sectional flow area of said throttle of said second oil passage is larger than a cross-sectional flow area of said throttle of said third oil passage, and a cross-sectional flow area of said fourth oil passage is larger than the flow areas of each of said throttles.

7. The oil passage construction of claim 4, wherein a single said throttle is associated with both said second and third passages for controlling flow therethrough.

* * * * *